US009396891B2

(12) United States Patent
Cernat et al.

(10) Patent No.: US 9,396,891 B2
(45) Date of Patent: Jul. 19, 2016

(54) SWITCHGEAR ARRANGEMENT

(71) Applicant: SIEMENS AKTIENGESELLSCHAFT, Munich (DE)

(72) Inventors: Radu-Marian Cernat, Berlin (DE); Volker Lehmann, Treuenbrietzen (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 35 days.

(21) Appl. No.: 14/378,809

(22) PCT Filed: Feb. 5, 2013

(86) PCT No.: PCT/EP2013/052234
§ 371 (c)(1),
(2) Date: Aug. 14, 2014

(87) PCT Pub. No.: WO2013/120733
PCT Pub. Date: Aug. 22, 2013

(65) Prior Publication Data

US 2015/0034601 A1 Feb. 5, 2015

(30) Foreign Application Priority Data

Feb. 16, 2012 (DE) ..... 10 2012 202 408

(51) Int. Cl.
*H01H 9/34* (2006.01)
*H01H 33/91* (2006.01)
*H01H 33/88* (2006.01)

(52) U.S. Cl.
CPC ..... *H01H 9/342* (2013.01); *H01H 33/91* (2013.01); *H01H 2033/888* (2013.01)

(58) Field of Classification Search
CPC ... H01H 33/88; H01H 33/7023; H01H 33/91; H01H 33/64; H01H 33/78; H01H 9/342; H01H 33/74
See application file for complete search history.

(56) References Cited

U.S. PATENT DOCUMENTS 4,471,187 A 9/1984 Sturzenegger et al.
5,978,200 A * 11/1999 Konma ..... H01H 33/91 218/157
6,040,970 A * 3/2000 Lehmann ..... H01H 33/7061 218/53
6,646,850 B1 11/2003 Bergmann et al.
6,660,954 B2 * 12/2003 Iwabuchi ..... H01H 33/91 218/51

(Continued)

FOREIGN PATENT DOCUMENTS

CN 1284202 A 2/2001
CN 1650381 A 8/2005

(Continued)

*Primary Examiner* — Truc Nguyen
(74) *Attorney, Agent, or Firm* — Laurence Greenberg; Werner Stemer; Ralph Locher

(57) ABSTRACT

A switchgear has an interrupter unit that includes an arc gap. A first and a second switching contact piece are movable relative to one another. A switching-gas duct originates in the arc gap and connects the arc gap to the surroundings of the interrupter unit. A hollow vessel arrangement delimits at least some sections of the switching-gas duct and is connected to one of the contact pieces. The hollow vessel arrangement includes an external outlet opening for the switching-gas duct.

12 Claims, 1 Drawing Sheet

(56) References Cited

U.S. PATENT DOCUMENTS

| | | | | |
|---|---|---|---|---|
| 7,041,928 | B2 | 5/2006 | Nowakowski | |
| 7,964,816 | B2 * | 6/2011 | Dufournet | H01H 33/901 218/154 |
| 8,389,886 | B2 | 3/2013 | Dahlquist et al. | |
| 8,779,316 | B2 * | 7/2014 | Drews | H01H 33/74 218/51 |
| 2002/0113040 | A1 * | 8/2002 | Imamura | H01H 33/91 218/43 |
| 2003/0127430 | A1 * | 7/2003 | Iwabuchi | H01H 33/91 218/43 |
| 2007/0068904 | A1 * | 3/2007 | Dahlquist | H01H 33/74 218/59 |
| 2011/0062116 | A1 * | 3/2011 | Kriegel | H01H 33/901 218/43 |
| 2013/0062313 | A1 * | 3/2013 | Sainz De La Maza Escobal et al. | H01H 33/7069 218/22 |

FOREIGN PATENT DOCUMENTS

| | | | |
|---|---|---|---|
| CN | 1941243 | A | 4/2007 |
| DE | 1889068 | U | 3/1964 |
| DE | 10221580 | B3 | 1/2004 |
| EP | 0075668 | A2 | 4/1983 |
| EP | 1835520 | A1 | 9/2007 |
| EP | 2120244 | A1 | 11/2009 |
| JP | S61127542 | U | 8/1986 |
| WO | 0077809 | A1 | 12/2000 |
| WO | 2013045233 | A1 | 4/2013 |

* cited by examiner

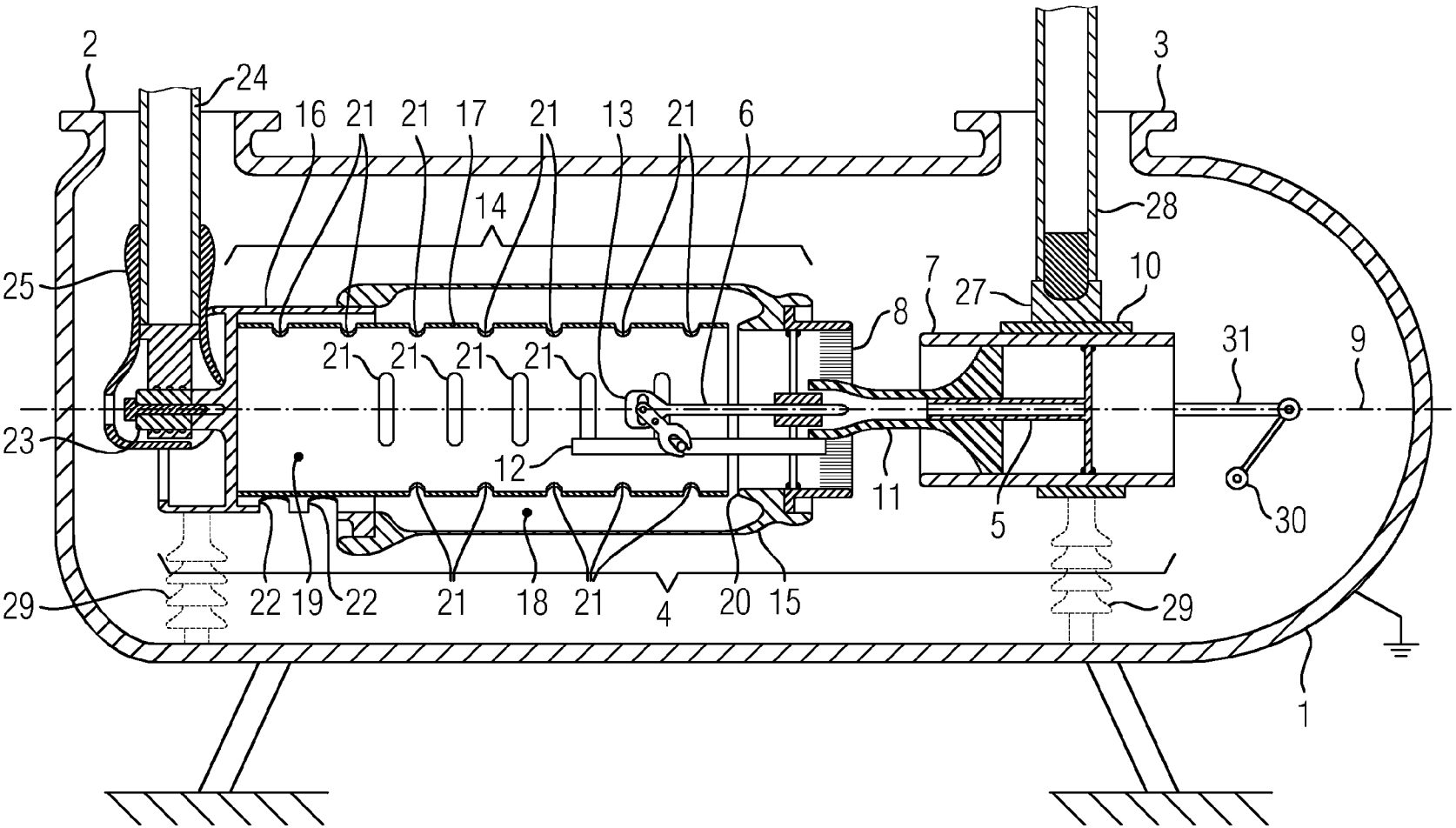
1
2
3
4
5
6
7
8
9
10
11
12
13
14
15
16
17
18
19
20
21
22
23
24
25
27
28
29
30
31

SWITCHGEAR ARRANGEMENT

BACKGROUND OF THE INVENTION

Field of the Invention

The invention relates to a switchgear arrangement having an interrupter unit comprising a first and a second switching contact piece, which are movable relative to one another, and comprising an arcing gas channel, which develops in an arc gap which can be formed between the switching contact pieces, which arcing gas channel passes through the interrupter unit and connects the arc gap to the surrounding environment of the interrupter unit and is at least sectionally delimited by a hollow-volume vessel arrangement, which is connected at a first end to one of the contact pieces.

Such a switchgear arrangement is known, for example, from the patent specification DE 102 21 580 B3. The switchgear arrangement disclosed therein comprises an interrupter unit having an arc gap and having switching contact pieces which are movable relative to one another. In order to dissipate arcing gas produced in the arc gap, an arcing gas channel is provided which develops in the arc gap and passes through the interrupter unit. A connection between the arc gap and the surrounding environment of the interrupter unit is produced by the arcing gas channel. The arcing gas channel is delimited by a hollow-volume vessel arrangement, which is connected to one of the contact pieces.

In the known arrangement, the arcing gas channel is configured in the interior of the vessel arrangement such that the arcing gas channel is multiply deflected by elements which surround one another and are arranged substantially coaxially. This makes it possible to swirl hot arcing gas along the flow path with cold insulating gas and ultimately to allow this swirled arcing gas to flow away into the surrounding environment of the interrupter unit. Owing to the coaxial arrangement of the elements which surround one another, the arcing gas is expelled in the axial direction. In order to position the interrupter unit, insulators are provided and the arcing gas emerging from the arcing gas channel is blasted towards said insulators. Likewise, electrical connections which are used for introducing the interrupter unit into an electrical network are subjected to the expelled arcing gas. In particular at the insulators it has proven to be critical that the arcing gas mixed with eroded particles flows towards the surface of the insulators. Even in the case of ribbing of the insulators, as prescribed by the patent specification DE 102 21 580 B3, there is the danger of an electrically conductive coating forming on the insulators after several switching operations, which represents a leakage current path between the interrupter unit and the encapsulating housing there. Such leakage current paths endanger the functionality of the known switchgear arrangement. In addition, premature ageing of the insulators subjected to blasting is to be expected owing to the thermal effect originating from the arcing gas.

BRIEF SUMMARY OF THE INVENTION

Therefore, the object of the invention consists in specifying a switchgear arrangement which has improved operational safety.

In accordance with the invention, the object is achieved in the case of a switchgear arrangement of the type mentioned at the outset by virtue of the fact that the hollow-volume vessel arrangement has, at a second end opposite the first end, a lateral-surface-side outlet opening of the arcing gas channel into the surrounding environment.

A switchgear arrangement is used for producing and interrupting a current path. For this purpose, the switchgear arrangement has an interrupter unit having switching contact pieces which are movable relative to one another. The switching contact pieces, in the state in which contact has been made, produce a current path and, in the state in which they are isolated from one another, ensure an isolating distance for the switchgear arrangement. An arc gap is arranged in the region of the switching contact pieces, with switching arcs occurring, for example, during a switching operation being guided within said arc gap. The space within which contact-making/isolation of contact regions of the switching contact pieces which are movable relative to one another takes place is referred to as the arc gap. The arc gap can be within a switching chamber. A switching chamber delimits, for example, the space in which an arc can burn. A switching arc occurs, for example, as prearcing during a make operation and as breaking arc during a break operation. The switching contact pieces can be in the form of rated-current contact pieces, arc contact pieces or combined rated-current and arc contact pieces, for example. In particular in the case of high-voltage use when switching high powers, it is advantageous to use separate rated-current and arc contact pieces so that, in the make state, a rated current is preferably passed via low-resistance rated-current contact pieces. Arcs occurring during a break operation or a make operation, on the other hand, are preferably passed to the arc contact pieces, which have a high capacity for resistance to thermal effects of an arc. The switching contact pieces can preferably be linearly displaceable with respect to one another, so that, in order to produce or eliminate an electrically conductive connection between the switching contact pieces, a linear movement is required. Pin-shaped switching contact pieces which are oriented with their pin longitudinal axis coaxial to a bush-shaped switching contact piece with a mirror-inverted shape have proven to be advantageous here. In this case, provision can be made for only one of the switching contact pieces to be driven so as to produce a relative movement and for the other switching contact piece to remain at rest. However, it may also be provided for both switching contact pieces to be mounted movably.

In the event of the occurrence of a switching arc, owing to the thermal effect thereof expansion of fluids such as gases and liquids which are located in the region of the arc gap can arise. In addition, evaporation of solid or liquid substances can take place, with the result that an arcing gas which is heated by the arc, expanded and contaminated with products of erosion is present in the arc gap. In order to protect the arc gap from bursting or to prevent any flow of the arcing gas out of the arc gap, an arcing gas channel is installed, which develops in the arc gap and has an inflow opening in the region of the arc gap. Preferably, the arcing gas channel can extend exclusively on a potential side of the arc gap. Thus, the transfer of potential beyond the arc gap is counteracted. Driven by a pressure increase originating from the arc within the arc gap, the arcing gas flows into an inflow opening of the arcing gas channel. The arcing gas channel is at least sectionally delimited by the hollow-volume vessel arrangement. Hollow bodies which accommodate and conduct the arcing gas in their interior are suitable as the hollow-volume vessel arrangement. Such a hollow body can be, for example, in each case substantially in the form of a balloon, in the form of a bottle, rotationally symmetrical, hollow-cylindrical etc. This hollow-volume vessel arrangement needs to have a corresponding resistive force with respect to pressures and thermal loads emerging from the arcing gas. The hollow-volume vessel arrangement should, once the arcing gas has moved out of the arcing gap, make available a section of the arcing gas channel in which the arcing gas can expand and can swirl. The hollow-volume vessel arrangement should be used as expansion volume. The hollow-volume vessel arrangement can in this case be formed in one or more pieces. For example, the hollow-volume vessel arrangement can have a basic body, for example in the form of a hood, which is preferably formed substantially rotationally symmetrically, for example. The hollow-volume vessel arrangement has a volume which is enlarged in comparison to the arc gap, with the result that an expansion volume is formed within the hollow-volume vessel arrangement, in which expansion volume the arcing gas can undergo a pressure reduction and temperature reduction. Advantageously, the hollow-volume vessel arrangement should be filled with an electrically insulating fluid in the same way as the arc gap. Insulating gases or insulating liquids are suitable, for example, as electrically insulating fluids. In this case, nitrogen and sulfur hexafluoride have proven to be advantageous. In order to further increase the dielectric strength, the insulating fluid located in the arc gap and hollow-volume vessel arrangement can be greatly increased in terms of its pressure. The insulating fluid should in this case preferably wash around the interrupter unit and flow through the interrupter unit. The insulating fluid located outside the interrupter unit in this case forms the surrounding environment of the interrupter unit, wherein the arcing gas channel lets the arcing gas led out of the arc gap out into the surrounding environment of the interrupter unit. The arcing gas leaves the arcing gas channel via the outlet opening and enters the surrounding environment. The use of one or more outlet openings can be provided.

In the region of the connection of the contact piece to the hollow-volume vessel arrangement, the arcing gas is introduced into the arcing gas channel. The arcing gas channel can in this case also be delimited by a switching contact piece, for example. This provides the possibility of introducing the arcing gas into the arcing gas channel over a short path directly at the location of its origin. The arcing gas channel extends in the interior of the hollow-volume vessel arrangement, wherein, within the hollow-volume vessel arrangement, the arcing gas can undergo expansion. As a result of the expansion, swirling with the (cold) electrically insulating fluid located in the interior of the hollow-volume vessel arrangement takes place. The region of the production of the arcing gas, namely in the region of the contact piece connected to the hollow-volume vessel arrangement, and the region of the outlet opening of the arcing gas into the surrounding environment of the interrupter unit need to be spaced as far as possible apart from one another so that the arcing gas can intermix in the interior of the hollow-volume vessel arrangement and cool down. The profile of the arcing gas channel prevents direct flashover of an arcing gas flowing through the hollow-volume vessel arrangement. In this case, the arcing gas should be deflected necessarily at least once through at least 90° in order to be directed out from an axial inflow direction into a radial outflow direction through an outlet opening in the lateral surface of the hollow-volume vessel arrangement. The arcing gas should preferably enter the hollow-volume vessel arrangement in the axial direction and flow out of the hollow vessel arrangement in a radial direction. It has proven to be advantageous here for the hollow-volume vessel arrangement to be configured as a substantially hollow cylinder, wherein, in particular substantially rotationally symmetrical hollow cylinders are advantageous. A substantially hollow cylinder is, within the meaning of this document, understood to mean a hollow body extending along a cylinder axis, which hollow body can also have different cross sections over the profile of the cylinder axis and which furthermore can have, for example, additional requirements at the end side. The arcing gas should in this case preferably be blown into the hollow-volume vessel arrangement in the direction of the cylinder axis, wherein the lateral-surface-side outlet opening of the arcing gas channel is arranged in a wall which encompasses the cylinder axis in intrinsically closed fashion, i.e. a lateral surface of the hollow-volume vessel arrangement. The hollow-volume vessel arrangement can have, for example, substantially a bottle-shaped structure, wherein the inflow opening of the arcing gas channel is arranged at a bottle neck with a reduced cross section, at one end, and an outlet opening is arranged on the lateral-surface side on the bottle base. The hollow-volume vessel arrangement can be formed, for example, at least sectionally in the form of a hood, i.e. have a substantially hollow-cylindrical structure, wherein cross sections which vary along the cylinder axis are quite possible. Thus, it is possible, for example, for a radially extended hood with an at least sectionally conical structure, for example, to be used.

A further advantageous configuration can provide that the hollow-volume vessel arrangement has, at the second end, an in particular substantially pot-shaped fitting body.

A fitting body is used for dielectric termination/closure of the hollow-volume phase conductor arrangement at its second end, remote from the first end. The fitting body should have, for this purpose, a dielectrically favorable shape in order to prevent discharge phenomena. The fitting body can in particular have a substantially pot-shaped design for this purpose. However, the fitting body can also have different dielectrically favorable shapes. The fitting body can in this case also be pot-shaped merely in one section and furthermore also have another shape. A fitting body can advantageously be designed to connect the hollow-volume vessel arrangement to a further contact element, with the result that the interrupter unit can be looped into a current path to be interrupted. The fitting body can be configured to be correspondingly conductive for this purpose, wherein in particular a pot shape is advantageous in respect of its dielectric properties. In this case, the fitting body should open towards the arc gap from a pot base with the lateral-surface walls surrounding the pot base on the lateral-surface side. This provides the possibility of connecting the fitting body to a basic body, for example, wherein the volume surrounded by the fitting body in a pot-shaped manner, together with the basic body of the hollow-volume vessel arrangement, provides a volume for formation of the arcing gas channel. For example, the basic body can be configured in the manner of a hood, wherein the hood opens in the direction of the fitting body and the pot-shaped fitting body in turn opens in the direction of the basic body. The openings in the hood and the pot-shaped fitting body can preferably abut one another or encompass one another so as to seal one another and delimit the inner volume of the hollow-volume vessel arrangement. By virtue of such a multi-part hollow-volume vessel arrangement, the volume bounded and delimited by the hollow-volume vessel arrangement can be enlarged. Furthermore, the possibility is provided of connecting differently dimensioned component parts to form a hollow-volume vessel arrangement. It is thus possible, for example, for a position for making contact with the interrupter unit to be set differently on the fitting body. However, provision can also be made for the fitting body to be free of electrical connection components, with the result that the fitting body only provides one volume which, together with a further body or a plurality of further bodies, delimits the hollow-volume vessel arrangement.

A further advantageous configuration can provide that the lateral-surface-side outlet opening is at least partially, in particular, completely, delimited by the fitting body.

A fitting body can be formed integrally, for example. For example, casting methods can be used for shaping the fitting body. Correspondingly, lateral-surface walls of the pot-shaped region of the fitting body can be used in order to delimit a lateral-surface-side outlet opening. However, provision can also be made for the fitting body to delimit only part of a lateral-surface-side outlet opening. Provision can thus be made for the outlet opening to be delimited, for example, jointly by different elements, which together surround the hollow-volume vessel arrangement.

Furthermore, provision can advantageously be made for a plug-type contact to be arranged on the fitting body.

A plug-type contact makes it more easily possible for the interrupter unit of the switchgear arrangement to be connected to a connection line. The fitting body can act as mount for a plug-type contact, and possibly sometimes itself be in the form of a plug-type contact. Depending on the shape of the switchgear arrangement, the plug-type contact can in this case be located at any desired positions. It is particularly advantageous here if the plug-type contact is arranged in the base region of a pot-shaped fitting body. In this case, the plug-type contact should in particular be arranged outside the volume which is enclosed in a pot-shaped manner, i.e. without being encompassed by a lateral-surface wall, in the base region of the fitting body. For example, when using a substantially rotationally symmetrical pot, the plug-type contact can be arranged as centrally as possible in the base region of the pot-shaped fitting body.

Furthermore, it can advantageously be provided that a pipe body dividing the arcing gas channel in the form of shells passes through the hollow-volume vessel arrangement on the inner lateral surface side.

The arcing gas channel can extend in a variety of ways in the interior of the hollow-volume vessel arrangement. By virtue of including a pipe body, it is possible for the interior of the hollow-volume vessel arrangement to be divided into different zones or subvolumes. In this case, provision can be made, for example, for the pipe to be substantially hollow-cylindrical, in particular substantially in the form of a circular ring and hollow-cylindrical, with the result that an (in particular circular-cylindrical) shell positioned centrally in the interior of the pipe body is surrounded by a substantially hollow-cylindrical shell. The shells are separated from one another by the pipe body. Provision can furthermore be made for a plurality of pipe bodies, nested one inside the other, to delimit a relatively large number of shell-like sections of the arcing gas channel. Advantageously, a main direction of throughflow of the pipe body should be directed substantially equally on the inner lateral surface side and the outer lateral surface side, so that intensive and quick swirling of arcing gas and dielectrically more favorable electrically insulating fluid is made possible. Thus, arcing gas can flow through the arcing gas channel in one direction. Changes of direction are reduced to a small number, wherein the main flow direction is maintained. Cross flows substantially serve to swirl the arcing gas. Arcing gas can flow continuously into and out of the arcing gas channel. Whilst maintaining the direction of flow, the arcing gas can swirl and possibly also temporarily flow in transverse directions and be overlapped by the main flow direction in the hollow-volume vessel arrangement.

Furthermore, it can advantageously be provided that the pipe body has, on the lateral surface side, at least one through-opening, via which shells separated by the pipe body communicate with one another.

It is possible for the inner shell which is encompassed by the pipe body and the outer shell which extends around the pipe body of the surrounded volume of the hollow-volume vessel arrangement to communicate with one another via through-openings. Thus, arcing gas components can transfer both from the interior of the pipe body into the outer region of the pipe body and in the opposite direction from the outer region around the pipe body into the inner region surrounded by the pipe body. Thus, despite flow directions in the same direction both on the inner lateral surface side and on the outer lateral surface, side cross flows are permitted at the pipe body, which cross flows permit rapid mixing of the arcing gas along the longitudinal axis of the pipe body. The main direction of flow extends in the direction of the longitudinal axis.

The through-openings provided can be, for example, slots whose longitudinal extent is substantially transverse to the longitudinal axis of the pipe body. In particular, an offset in the position of the through-openings can be provided. The position of the through-openings can in this case vary. However, provision should be made for through-openings which are positioned in the region of the fitting body to provide a passage possibility for the arcing gas exclusively in one and the same (radial) direction.

Advantageously, it can be provided that the pipe body has, on the lateral surface side, at least one through-opening which is spanned, with a spacing, by the hollow-volume vessel arrangement, in particular by the fitting body.

A through-opening can be spanned, spaced apart from the pipe body, by a closed wall of the hollow-volume vessel arrangement, in particular of the fitting body. The spanning wall should be on the outer lateral surface side with respect to the pipe body. The wall acts as a deflector for arcing gas passing through the spanned through-opening. Advantageously, a spanned through-opening should be covered by a section of a lateral surface wall of the fitting body which surrounds the pot base. As a result, there is the possibility of arcing gas passing through the through-opening being allowed to flow against the spanning wall of the fitting body and being deflected there. The wall represents a barrier.

Furthermore, it can advantageously be provided that the pipe body spans, with a spacing, the outlet opening of the arcing gas channel.

Correspondingly, it can also be provided that the outlet opening of the arcing gas channel is spanned by a closed wall of the pipe body. The wall acts as deflector for arcing gas. In this case, in particular it can be provided that the pipe body is arranged in front of the outlet opening on the inner lateral surface side, with the result that arcing gas is prevented from emerging directly out of the shell surrounded by the pipe body within the hollow-volume vessel arrangement via an outlet opening into the surrounding environment of the interrupter unit. Correspondingly, a barrier is provided which additionally deflects and deflects away the arcing gas seeking the outlet opening, as a result of which, for example, it is also possible for parts of the arcing gas flow which flow both on the inner lateral surface side and on the outer lateral surface side along the pipe body to be introduced into one another. Thus, additional swirling shortly before emergence of the arcing gas into the surrounding environment of the interrupter unit is effected.

Advantageously, it can furthermore be provided that the outlet opening and the through-opening are arranged offset with respect to one another.

An offset of the outlet opening and the through-opening prevents a direct emergence of arcing gas components passing a through-opening through the outlet opening into the surrounding environment of the interrupter unit. In particular, the outlet opening and the through-opening should be provided in diametrically opposite sections in the wall of the hollow-volume vessel arrangement (preferably in the fitting body) and the wall of the pipe body. This ensures that, directly prior to an emergence of the arcing gas from the arcing gas channel, the arcing gas is forced at least partially onto a circulation path around the pipe body. These are in particular the arcing gas components which flow through through-openings in the region of the second end of the hollow-volume vessel arrangement. Thus, for example, in addition to a substantially axial continuance of the arcing gas prior to emergence of the arcing gas through the outlet opening, rotation of the arcing gas can also be effected, wherein, in this rotating arcing gas flow, prior to emergence of the arcing gas out of the arcing gas channel, an axially flowing component of the arcing gas can also be deflected. Mixing of the arcing gas with electrically insulating fluid is thus additionally promoted and assisted. At the second end of the hollow-volume vessel arrangement, the outlet opening(s) should be opposite the through-opening(s) in the region of the second end of the hollow-volume vessel arrangement. Thus, in the region of the second end, through-openings and outlet openings have substantially the same gas passage direction. However, the openings are arranged opposite one another on different assemblies. In particular, the offset should be provided such that, in relation to a vertical axis which intersects, substantially perpendicularly, the pot base of the fitting body and which is oriented parallel to or in congruence with the cylinder axis of the hollow-volume vessel arrangement, an offset of the outlet opening and through-opening is provided in the circumferential direction. Thus, in the region of the second end, an axial overlap of outlet openings and through-openings can be permitted. At the second end, in particular in an axial region, all of the through-openings located there and all of the outlet openings located there should each allow arcing gas to pass through in a common jet direction. The jet directions of the through-openings and the outlet openings should be different than one another. The jet directions can also be substantially parallel to one another. In this case, the arcing gas should flow with opposite direction sense through through-openings and outlet openings.

The through-opening and the outlet opening can in this case be shaped in the manner of slots, for example, wherein both the outlet opening and the through-opening can be located on one and the same circulation path, wherein the outlet opening and the through-opening should be arranged at diametrically opposite points on the circulation path.

Advantageously, it can furthermore be provided that the pipe body, supported on the fitting body, protrudes in cantilevered fashion into the hollow-volume vessel arrangement.

The pipe body being supported on the fitting body enables simplified fitting of the interrupter unit since the pipe body can be fitted together with the fitting body during completion of the hollow-volume vessel arrangement, for example. The pipe body can, for example, protrude into the pot-shaped cutout as far as into the pot base and rest on the pot base so that the pipe body is connected at the end side to a base of the pot-shaped fitting body. The pipe body preferably protrudes, starting from the base region of the fitting body, through the pot-shaped lateral surface wall and protrudes beyond the fitting body and passes through a majority of the extent of the hollow-volume vessel arrangement between the first and second ends. In this case, the pipe body is preferably spaced apart from the lateral surface walls of the pot-shaped fitting body, with the result that an annular gap is formed on the outer lateral surface side on the pipe body. Preferably, the pipe body should be connected to the pot base of the fitting body in the manner of a circular ring. By virtue of the cantilevered configuration of the pipe body, bearing and supporting internals in the interior of the hollow-volume vessel arrangement are not required. Furthermore, as a result of a cantilevered design, simplified fitting of the fitting body is provided. The fitting body can be orientated, for example, with its free end aligned with respect to one of the contact pieces or with respect to an inflow opening of the arcing gas channel in the arc gap of the hollow-volume vessel arrangement, with the result that arcing gas flowing into the interior of the hollow-volume phase conductor arrangement through an inflow opening preferably first flows into the inner region surrounded by the pipe body. A gap can remain between the free end of the pipe body and an inflow opening of the hollow-volume vessel arrangement, which gap acts in the same way as the through-openings.

The pipe body can comprise, for example, electrically conductive material.

A further advantageous configuration can provide that a shell of the arcing gas channel having a ring-shaped cross section is delimited between the pipe body and the hollow-volume vessel arrangement, wherein the flow resistance of the ring-shaped shell at the first end of the hollow-volume phase conducter arrangement is less than at the second end of the hollow-volume vessel arrangement.

The pipe body divides the hollow volume of the hollow-volume vessel arrangement into different shells, which surround one another. For example, a cylindrical shell can be provided centrally in the interior of the pipe body, which cylindrical shell is encompassed on the outer lateral surface side, separated by the pipe body, by a hollow-cylindrical shell. A flow of arcing gas is produced in each of the shells, wherein the main direction of flow of the arcing gas is directed in the same direction in each of the shells. Communication between the individual shells is made possible via the through-openings. If an increase in the flow resistance, starting from the first side of the hollow-volume vessel arrangement towards the second side of the hollow-volume vessel arrangement now takes place in the outer shell with a ring-shaped cross section, it is possible to first allow expansion of the inflowing arcing gas, wherein, with a reduction in cross section and increased flow resistance in the direction of the outlet opening of the arcing gas channel into the surrounding environment, renewed acceleration of the flow within the arcing gas channel can be enforced. It is thus possible, firstly, for the arcing gas in the lower-resistance section, which is arranged in the direction of the first side of the hollow-volume vessel arrangement, to perform expansion of the arcing gas and for this expanded arcing gas then to be pressed into the region of the shell with increased resistance, as a result of which an increase in the rate of flow of the flowing-away arcing gas results at the second end. Thus, rapid emergence of arcing gas out of the arcing gas channel can be promoted. An increase in resistance can be performed stepwise or else continuously by changing the cross section of the arcing gas channel.

Advantageously, it can be provided that at the hollow-volume vessel arrangement, the ring-shaped shell is delimited at the second end by the fitting body and at the first end by a hood accommodating the fitting at the end.

By virtue of a corresponding cross-sectional configuration of the fitting body and the hood, it is possible in a simple manner to connect the hood and the fitting body to one another and in the process to terminate the hollow-volume phase conductor arrangement. For example, it can be provided that the hood is substantially hollow-cylindrical or else shaped in the manner of a cone, for example, wherein the fitting body is encompassed by the hood and is inserted into the hood. In this case, the openings in the fitting body and the hood opening should face one another, with the result that the volumes of the hood and the pot can supplement one another to form a total volume of the hollow-volume vessel arrangement. A sealing compound between the hood and the pot is advantageous so as to drive the arcing gas in the direction of the outlet opening. The bond point can be used to form a transition from the section with a lower level of flow resistance in the section of the ring-shaped shell with a greater flow resistance. The two sections are preferably each delimited by the hood and the fitting body, wherein the hood and the fitting body, as a result of differing cross sections, influence the flow resistance differently. Therefore, firstly a simplified combination of fitting body and hood is provided. Secondly, a reduction in cross section is thus performed in a simple manner in order to effect changed flow resistances in a shell. Furthermore, a reduction in cross section of the outer sleeve contour of the interrupter unit can thus also be achieved. In the case of an arrangement of the lateral-surface-side outlet opening on the fitting body, the outlet opening is located in a region which, in a projection in the direction of the cylinder axis, is completely protruded over by the hood. Thus, this region is additionally dielectrically shielded by the hood.

A further advantageous configuration can provide that the hollow-volume vessel arrangement is a phase conductor arrangement which is in electrical contact with one of the contact pieces.

A formation of the hollow-volume vessel arrangement as phase conductor arrangement has the advantage that one of the contact pieces is brought into electrically conductive contact with the hollow-volume vessel arrangement. By virtue of a configuration as a phase conductor arrangement, the hollow-volume vessel arrangement can be used to form a section of a current path to be interrupted or switched by the switchgear arrangement. The hollow-volume vessel arrangement can be manufactured from metallic cast pieces, for example. Thus, provision can be made, for example, for the fitting body to be manufactured as cast aluminum. Furthermore, a basic body which is connected to the fitting body can likewise be manufactured from cast aluminum. This provides the possibility of firstly making electrical contact with one of the contact pieces. Secondly, the hollow-volume vessel arrangement can be advantageously shaped dielectrically. For example, the hollow-volume vessel arrangement can extend substantially rotationally symmetrically with respect to a longitudinal axis or cylinder axis so that the hollow volume which is surrounded by the hollow-volume vessel arrangement is dielectrically protected. Thus, assemblies which have projecting edges, for example, can also be arranged within the hollow-volume vessel arrangement. For example, a deflecting gear mechanism for driving a movable contact piece can also protrude at least partially into the hollow-volume vessel arrangement. Furthermore, the hollow-volume vessel arrangement can be used as part of the current path to be interrupted or current path to be produced by the switchgear arrangement. A contact piece in contact with the hollow-volume vessel arrangement should be permanently in contact with the hollow-volume phase conductor arrangement so that, independently of a switch position of the interrupter unit, the hollow-volume vessel arrangement and the contact piece conduct the same electrical potential.

Furthermore, it can advantageously be provided that at least one of the contact pieces is borne by the hollow-volume vessel arrangement.

The hollow-volume vessel arrangement for its part needs to have sufficient mechanical and thermal stability in order to provide a resistance to the arcing gases flowing in the interior. Correspondingly, the hollow-volume vessel arrangement has an angularly rigid structure, which can also be used to stabilize the interrupter unit. The hollow-volume vessel arrangement can thus be used, for example, as supporting element for positioning one of the contact pieces in the interior of the switchgear arrangement. The hollow-volume vessel arrangement can encompass, on the outer lateral surface side, one of the contact pieces, for example, and accommodate said contact piece in the manner of a pipe connecting piece, for example. Via such a pipe connecting piece it is possible to provide an inflow opening in the arcing gas channel towards the arc gap, wherein arcing gas entering into the arcing gas channel out of the arc gap, for example, can flow freely into the interior of the hollow-volume vessel arrangement through said pipe connecting piece/contact piece. Furthermore, by virtue of the contact piece being supported, in particular at the first end of the hollow-volume vessel arrangement, the possibility is provided of supporting the hollow-volume vessel arrangement itself in the region of the second end and leading out the first end in cantilevered fashion. Thus, the electrically active parts of the contact point can be kept spaced apart from holding points of the interrupter unit via the hollow-volume vessel arrangement. It is thus possible to relieve the contact pieces themselves of the load of holding and guiding functions and to channel holding and guiding forces via the hollow-volume vessel arrangement. Correspondingly, additional supporting guidance and positioning mechanisms for a contact piece borne by the hollow-volume vessel arrangement are not required.

An exemplary embodiment of the invention will be illustrated schematically in a drawing and described in more detail below.

BRIEF DESCRIPTION OF THE DRAWING

In the drawing,

The FIGURE shows a section through a switchgear arrangement.

DESCRIPTION OF THE INVENTION

The FIGURE shows a section through a switchgear arrangement in a schematic embodiment. The switchgear arrangement has a housing 1. The housing 1 is in this case a cast housing consisting of electrically conductive material, for example aluminum, which conducts ground potential. The housing 1 has a first flange 2 and a second flange 3. The housing 1 is configured as a pressure-tight encapsulated housing, with the result that an excess pressure can be built up and a fluid enclosed in the interior of the housing 1.

An interrupter unit 4 of the switchgear arrangement is arranged in the interior of the housing 1. The interrupter unit 4 has a first arc contact piece 5 and a second arc contact piece 6 as well as a first rated current contact piece 7 and a second rated current contact piece 8. The first arc contact piece 5 and the first rated current contact piece 7 are in galvanic contact with one another permanently. The second arc contact piece 6 and the second rated current contact piece 8 are likewise permanently in galvanic contact with one another. As a result, the mutually assigned contact pieces 5, 6, 7, 8 are permanently subject to the same electrical potential. The first arc contact piece 5 is hollow-cylindrical and has a bush-shaped contact region. The first arc contact piece 5 is arranged coaxially with respect to a longitudinal axis 9. The second arc contact piece 6 is arranged opposite the first arc contact piece 5 at the end side, wherein the second arc contact piece 6 is substantially in the form of a pin and oriented coaxially with respect to the longitudinal axis 9. Both the first arc contact piece 5 and the second arc contact piece 6 are drivable so as to generate a switching movement, wherein the first arc contact piece 5 and the second arc contact piece 6 are each mounted movably and drivably along the longitudinal axis 9. The first arc contact piece 5 and the second arc contact piece 6 always move in the opposite direction. The second arc contact piece 6 is shaped at its contact region in mirror-inverted fashion with respect to the bush-shaped contact region of the first arc contact piece 5, with the result that the second arc contact piece 6 can be introduced into the first arc contact piece 5 so as to produce a current path. The first rated current contact piece 7 is in the form of a pipe and surrounds the first arc contact piece 5 on the outer lateral surface side and is oriented coaxially with respect to the longitudinal axis 9. The second rated current contact piece 8 surrounds the second arc contact piece 6 on the outer lateral surface side, wherein the second rated current contact piece 8 is oriented coaxially with respect to the second arc contact piece 6. The second rated current contact piece 8 has a contact bush with elastic contact fingers, into which an outer lateral surface of the tubular first rated current contact piece 7 can be introduced. The second rated current contact piece 8 is mounted fixed in position. The first rated current contact piece 7 is displaceable, together with the first arc contact piece 5, along the longitudinal axis 9. In order to position the first arc contact piece 5 and the first rated current contact piece 7, a guide bush 10 is provided. The guide bush 10 is oriented coaxially with respect to the longitudinal axis 9. The guide bush 10 encompasses the first rated current contact piece 7 on the outer lateral surface side. A sliding contact arrangement is arranged between the guide bush 10 and the first rated current contact piece 7. An insulating nozzle 11 is connected in angularly rigid fashion to the first arc contact piece 5 and to the first rated current contact piece 7. The insulating nozzle 11 surrounds the first arc contact piece 5 on the outer lateral surface side and is itself at least sectionally encompassed by the first rated current contact piece 7. The insulating nozzle 11 provides an insulating nozzle channel, into which or through which the second arc contact piece 6 can pass during a switching operation. An arc burning between the arc contact pieces 5, 6 is thus prevented from bulging out radially.

A push rod 12 is connected to the insulating nozzle 11. A movement of the first rated current contact piece 7 or of the first arc contact piece 5 via the arc gap between the contact pieces 5, 6, 7, 8 can be transferred via the push rod 12. Short-circuiting of the arc gap is prevented by the electrically insulating nozzle 11. It is thus possible to couple a movement onto the second arc contact piece 6. For this, a deflecting gear mechanism 13 is furthermore used, which transfers a linear movement of the coupling rod 12, via a two-armed lever, onto the second arc contact piece 6. By virtue of the deflecting gear mechanism 13, transformation of the movement is made possible, with the movement being reversed in terms of its direction.

The second rated current contact piece 8 has struck against a hollow-volume vessel arrangement 14 at the end side. The hollow-volume vessel arrangement 14 encompasses the second rated current contact piece 8 on the outer lateral surface side. The hollow-volume vessel arrangement 14 is electrically conductive as a phase conductor arrangement and is part of a current path to be switched by the switchgear arrangement. The second rated current contact piece 8 and the second arc contact piece 7 are held mechanically via the hollow-volume vessel arrangement 14. Furthermore, contact-making between the second rated current contact piece 8 and the second arc contact piece 6 is performed via the hollow-volume housing arrangement 14. The hollow-volume phase conductor arrangement 14 has a basic body 15. The basic body 15 is in the form of a hood, which has a hollow-cylindrical or conical nature. Contact is made with the second rated current contact piece 8 at a first end of the hollow-volume vessel arrangement 14. A pot-shaped fitting body 16 is arranged at a second end, which is opposite the first end (in relation to the longitudinal axis 9 or the cylinder axis of the basic body 15). The pot-shaped fitting body 16 and the basic body 15 in the form of a hood face one another with their respective pot opening or hood opening so that the subvolumes encompassed by the pot-shaped fitting body 16 and the basic body 15 complement one another and together provide a volume for the hollow-volume vessel arrangement 14. Provision is made here for the pot-shaped fitting body 16 to be encompassed with its lateral surface side pot walls on the outer lateral surface side by the basic body 15, wherein the basic body 15 has a larger cross section than the pot-shaped fitting body 16. There is thus a reduction in the cross section surrounded in the interior of the hollow-volume vessel arrangement 14 at the transition between the basic body 15 and the pot-shaped fitting body 16.

A pipe body 17 passes through the hollow-volume vessel arrangement 14 virtually over its entire axial extent. The pipe body 17 advantageously has a hollow-cylindrical basic structure with in particular a cross section in the form of a circular ring. The pipe body 17 therefore divides the volume delimited by the hollow-volume vessel arrangement 14 such that a plurality of shells within the hollow-volume vessel arrangement 14 are formed. This results in a shell 18 with a cross section in the form of a circular ring between the outer lateral surface side of the pipe body 17 and the inner lateral surface side of the hollow-volume phase conductor arrangement 14. Furthermore, a further shell 19 with a fully cylindrical cross section is produced centrally in the interior of the pipe body. The shell 18 has a larger cross section at its first end facing the second rated current contact piece 8 than at its second end facing the pot-shaped fitting body 16. The pipe body 17 is connected at its end side flush to the pot base of the pot-shaped fitting body 16. The pipe body 17 extends, starting from the pot base or starting from the pot-shaped fitting body 16, through the hollow-volume vessel arrangement 14 in the direction of the second rated current contact piece 8. The pipe body 17 is in this case designed so as to protrude into the space in cantilevered fashion, wherein the free end of the pipe body 17 is spaced apart from a pipe connecting piece 20. A ring gap is formed between the pipe connecting piece 20 and the free end of the pipe body 17. In this case, the pipe connecting piece 20 is formed as part of the hollow-volume vessel arrangement 14, wherein the pipe connecting piece 20 can also be configured as a discrete assembly or else as part of the second rated current contact piece 8. The pipe connecting piece 20 encompasses a cross section which is shaped so as to be substantially aligned with the cross section of the bush of the second rated current contact piece 8. The arcing gas channel which develops in an arc gap passes through the second rated current contact piece 8. The arc gap is the space in which contact-making, and isolation of the contact regions of the contact pieces 5, 6, 7, 8 takes place. An arc gap is in this case arranged between the two arc contact pieces 5, 6. A further arc gap is arranged between the rated current contact pieces 7, 8. The arcing gas channel develops both in one arc gap and in the other arc gap. It is thus ensured that, in each of the arc gaps, possibly generated arcing gas can be dissipated via the same arcing gas channel. The pipe body 17 is provided with through-openings 21, which are introduced in the lateral surface side. The through-openings 21 are distributed symmetrically over the circumference, with the result that communication between the shell 18 and the further shell 19 is enabled via the through-openings 21. The through-openings 21, which are in the region of the pot-shaped fitting body 16, are oriented exclusively in one direction. A closed wall is formed on the pipe body 17 in such a way as to span the through-opening 18 in the region of the pot-shaped fitting body 16, with an arrangement of through-openings 21 in said closed wall having been dispensed with.

Outlet openings 22 in the arcing gas channel are introduced into the lateral surface wall on the lateral surface side on the pot-shaped fitting body 16. In this case, the position of the outlet openings 22 in the pot-shaped fitting body 16 is provided such that the through-openings 21 are oriented diametrically opposite the outlet openings 22 in the region of the pot-shaped fitting body 16. Outlet openings 22 and through-openings 21 are arranged offset with respect to one another. Thus, the through-openings 21 are spanned on the outer lateral surface side by a wall of the hollow-volume phase conductor arrangement 14. The outlet openings 22, on the other hand, are spanned on the inner lateral surface side by a wall of the pipe body 17.

This ensures that, once arcing gas has passed through the through-openings 21 in a radial direction, first it crashes into a wall covering the through-opening 21 and only then is it possible, again by means of radial deflection, for there to be an emergence out of the outlet openings 22.

A plug-type contact 23 is arranged on the pot-shaped fitting body 16. In this case, the plug-type contact 23 is screwed by means of a screw connection on the pot base of the pot-shaped fitting body 16, wherein a first connection line 24 is connected to the plug-type contact 23. The first connection line 24 protrudes through the first flange 2 and is used for coupling the switchgear arrangement into a switchgear assembly, for example. In order to provide dielectric shielding of the plug-type contact 23, the plug-type contact 23 is surrounded by a shielding hood 25. A shielding ring 26 is formed integrally on the pot-shaped fitting body 16, which shielding ring, together with the shielding hood 25, provides dielectric shielding of the region of the plug-type contact 23. In addition to an end-side central arrangement of the plug-type contact 23, the latter can also be arranged eccentrically, on the lateral surface side or in another way on the pot-shaped fitting body 16, for example. Electrical contact-making of the hollow-volume vessel arrangement 14 is provided via the plug-type contact 23 and the first connection line 24, so that the fitting body 16 and the basic body 15, as parts of the hollow-volume vessel arrangement 14, act as current path for feeding an electric current to the second rated current contact piece 8/the second arc contact piece 6.

A further plug-type contact 27 is arranged on the lateral surface side on the guide bush 10, with a second connection line 28 being plugged into said further plug-type contact with electrical contact being made. The second connection line 28 protrudes through the second flange 3 and is used for making electrical contact with the first rated current contact piece 7 or the first arc contact piece 5 with the guide bush 10 interposed. The two connection lines 25, 28 can for their part be supported in a manner which is electrically insulated relative to the housing 1, wherein the interrupter unit 4 can also be positioned via the plug-type connections 23, 27. A dash-dotted line in the FIGURE indicates the use of separate insulators 29, via which the interrupter unit 4 can alternatively or additionally be supported on the housing 1. The flange openings in the first and second flanges 2, 3 can be sealed in a gas-tight and pressure-tight manner, for example using electrically insulating closure means, through which the connection lines 24, 28 pass. It is thus possible to fill the interior of the housing 1 with an electrically insulating fluid, for example sulfur hexafluoride gas or nitrogen gas or mixtures with these gases. When the housing 1 is configured as a pressure-tight housing, applying excess pressure to the fluid in the interior of the housing 1 is made possible. Thus, an electrically insulating fluid is flushed around the interrupter unit 4, and the electrically insulating fluid is flushed through the interrupter unit. The electrically insulating fluid which is enclosed in the housing 1 and which surrounds the interrupter unit 4 represents the surrounding environment of the interrupter unit 4, into which arcing gas expelled out of the outlet openings 22 is emitted.

A make operation and a break operation and the arcing gas flows occurring in the process will be described by way of example below. The FIGURE illustrates the switchgear arrangement in the break state, i.e. both the rated current contact pieces 7, 8 and the arc contact pieces 5, 6 are separated from one another. An insulating gap which is filled with electrically insulating fluid is formed between the switching contact pieces 5, 6, 7, 8. During a make operation, a movement of the first rated current contact piece 7 and of the first arc contact piece 5 and of the insulating nozzle 11 in the direction of the second rated current contact piece 8 is initiated. For this purpose, a shaft 30 passes through the housing 1, with a pivot lever being fastened on said shaft. A rotary movement of the shaft 30 is converted into a linear movement in the direction of the longitudinal axis 9 via the pivot lever and a conrod 31. The shaft 30 passes through the housing 1 in fluid-tight fashion, with the result that a drive movement can be transmitted from outside the housing 1 into the interior of the housing 1 in fluid-tight fashion. A movement of the first arc contact piece 5 and the first rated current contact piece 7 and the insulating nozzle 11 in the direction of the second rated current contact piece 8 effects a movement of the coupling rod 12 and driving of the deflecting gear mechanism 13. As a result, the second arc contact piece 6 is driven in the direction of the first arc contact piece 5, with the result that contact-making of the arc contact pieces 5, 6 is performed temporally prior to contacting of the rated current contact pieces 7, 8. This ensures that a make arc is routed between the arc contact pieces 5, 6. In the event of the occurrence of a make arc, said arc is quenched directly after galvanic touching contact between the two arc contact pieces 5, 6. The rated current contact pieces 7, 8 can then come into galvanic contact with one another, wherein a virtually arc-free commutation of a current from the arc contact pieces 5, 6 onto the rated current contact pieces 7, 8 is possible.

During a break operation, a movement in the reverse direction is initiated, i.e. the first rated current contact piece 7 and the first arc contact piece 5 are moved from the second arc contact piece 6 or the second rated current contact piece 8. First the two rated current contact pieces 7, 8 are separated from one another. A break current can commutate virtually without any formation of arcs onto the arc contact pieces 5, 6, which are separated from one another temporally in succession. With the separation, striking of an arc may arise, depending on the current to be interrupted. The arc is preferably routed within the insulating nozzle channel. The arc expands electrically insulating fluid, evaporates the electrically insulating fluid, evaporates insulating material of the insulating nozzle 11 and likewise evaporates conductor material of the arc contact pieces 5, 6. An arcing gas is produced. The arcing gas has a lower dielectric strength than the electrically insulating fluid. Owing to the expansion and thermal effect, an excess pressure arises in the arc gap. The arcing gas is driven out of the arc gap owing to this excess pressure into the arcing gas channel. In this case, the arcing gas first passes an inflow opening of the arcing gas channel in the second rated current contact piece 8. The arcing gas is driven into the further shell 19 and will first flow in the axial direction through the pipe body 17. The arcing gas, driven by arcing gas which flows continuously thereafter, can also overflow into the first shell 18 via the through-opening 21 and, during this flow, mixing of the inflowing contaminated arcing gases with electrically insulating fluid located within the hollow-volume vessel arrangement 14 takes place. The arcing gas in the process first flows from the first end of the hollow-volume vessel arrangement 14 to the second end of the hollow-volume vessel arrangement 14. There, it is firstly driven out of the through-openings 21 in the region of the pot-shaped fitting body 16 in the radial direction against the spanning wall of the fitting body 16 and, from there, is deflected in the circumferential direction and then expelled through an outlet opening 22. Furthermore, this expulsion is superimposed by an axial component of the proportions of arcing gas which are already located in the first shell 18 within the hollow-volume phase conductor arrangement 14, as a result of which the axial and radial arcing gas proportions are superimposed on one another and mixed prior to passing through the outlet openings 22. Radial components and axial components of the arcing gas flow are directed into one another prior to emergence through the outlet openings 22, with the result that, even directly prior to passage of the arcing gas through the outlet openings 22 into the surrounding environment, additional swirling is ensured.

The invention claimed is:

1. A switchgear arrangement, comprising:

an interrupter unit having first and second switching contact pieces movably disposed relative to one another;

an arcing gas channel issuing from an arc gap to be formed between said switching contact pieces, passing through said interrupter unit and connecting said arc gap to a surrounding environment of said interrupter unit;

a hollow-volume vessel arrangement having a first end connected at one of said contact pieces and at least sectionally delimiting said arcing gas channel;

said hollow-volume vessel arrangement having a second end opposite said first end, said second end being formed with a lateral-surface-side outlet opening of said arcing gas channel into the surrounding environment of said interrupter unit;

said hollow-volume vessel arrangement having a substantially pot-shaped fitting body at said second end;

a pipe body, dividing said arcing gas channel in the form of shells, and passing through said hollow-volume vessel arrangement on an inner lateral surface side, said pipe body having, on the lateral surface side, at least one through-opening, via which shells separated by said pipe body communicate with one another;

said outlet opening and said at least one through-opening being offset with respect to one another.

2. The switchgear arrangement according to claim 1, wherein said fitting body is disposed to at least partially delimit said lateral-surface-side outlet opening.

3. The switchgear arrangement according to claim 1, wherein said fitting body is disposed to completely delimit said lateral-surface-side outlet opening.

4. The switchgear arrangement according to claim 1, which comprises a plug-type contact disposed on said fitting body.

5. The switchgear arrangement according to claim 1, wherein said pipe body has, on the lateral surface side, at least one through-opening which is spanned, with a spacing, by said hollow-volume vessel arrangement.

6. The switchgear arrangement according to claim 5, wherein said at least one through-opening is spanned by said fitting body.

7. The switchgear arrangement according to claim 1, wherein said pipe body spans said outlet opening of said arcing gas channel with a spacing.

8. The switchgear arrangement according to claim 1, wherein said pipe body is supported on said fitting body and protrudes in cantilevered fashion into said hollow-volume vessel arrangement.

9. The switchgear arrangement according to claim 1, which comprises a shell of said arcing gas channel having a ring-shaped cross section and being delimited between said pipe body and said hollow-volume vessel arrangement, and wherein a flow resistance of said ring-shaped shell at said first end of said hollow-volume vessel arrangement is less than a flow resistance at said second end of said hollow-volume vessel arrangement.

10. The switchgear arrangement according to claim 9, wherein said ring-shaped shell is delimited at said second end of said hollow-volume vessel arrangement by a fitting body and at said first end thereof by a hood accommodating said fitting body at an opposite end.

11. The switchgear arrangement according to claim 1, wherein said hollow-volume vessel arrangement is a phase conductor in electrical contact with one of said first and second switching contact pieces.

12. The switchgear arrangement according to claim 1, wherein at least one of said contact pieces is borne by said hollow-volume vessel arrangement.

* * * * *